US009086204B2

(12) United States Patent
Zou et al.

(10) Patent No.: US 9,086,204 B2
(45) Date of Patent: Jul. 21, 2015

(54) REFLECTOR, ILLUMINATOR AND THE USE THEREOF

(71) Applicant: GE Lighting Solutions, LLC, East Cleveland, OH (US)

(72) Inventors: Jiping Zou, Shanghai (CN); Yun Jiang, Shanghai (CN); Chao Pan, ShaanXi (CN); Cuijuan Zhou, Shanghai (CN)

(73) Assignee: GE LIGHTING SOLUTIONS, LLC., East Cleveland, OH (US)

( * ) Notice: Subject to any disclaimer, the term of this patent is extended or adjusted under 35 U.S.C. 154(b) by 0 days.

(21) Appl. No.: 14/352,166

(22) PCT Filed: Oct. 19, 2012

(86) PCT No.: PCT/US2012/060969

§ 371 (c)(1),
(2) Date: Apr. 16, 2014

(87) PCT Pub. No.: WO2013/059557

PCT Pub. Date: Apr. 25, 2013

(65) Prior Publication Data

US 2015/0009668 A1 Jan. 8, 2015

(30) Foreign Application Priority Data

Oct. 19, 2011 (CN) ..... 2011 1 0342006

(51) Int. Cl.
*F21V 7/00* (2006.01)
*F21S 8/08* (2006.01)
(Continued)

(52) U.S. Cl.
CPC ..... *F21V 7/0083* (2013.01); *F21K 9/50* (2013.01); *F21S 8/08* (2013.01); *F21V 7/0025* (2013.01);
(Continued)

(58) Field of Classification Search
CPC ..... F21V 7/0083; F21V 7/0025
USPC ..... 362/241, 296.01, 297, 298, 341, 346, 362/347
See application file for complete search history.

(56) References Cited

U.S. PATENT DOCUMENTS 4,593,485 A 6/1986 Thillays
8,231,244 B2 7/2012 He et al.
(Continued)

FOREIGN PATENT DOCUMENTS

CN 201072071 6/2006
CN 201237118 5/2009
(Continued)

OTHER PUBLICATIONS

International Search Report and Written Opinion dated Jan. 23, 2013 which was issued in connection with PCT Patent Application No. PCT/US12/060969 which was filed on Oct. 19, 2012.
(Continued)

*Primary Examiner* — Vip Patel
(74) *Attorney, Agent, or Firm* — GE Global Patent Operation; Peter T. DiMauro

(57) ABSTRACT

A reflector including pairs of reflecting pieces, each pair of reflecting pieces includes at least one reflecting unit, each reflecting unit including a first reflecting portion, a second reflecting portion, and a first fixing portion and a second fixing portion whose bottom ends are respectively connected to the first reflecting portion and the second reflecting portion. The first fixing portion is located on the side of the first reflecting portion that is opposed to an optical center of the reflecting unit, and the second fixing portion is located on the side of the second reflecting portion that is opposed to the optical center of the reflecting unit.

20 Claims, 10 Drawing Sheets

(51) Int. Cl.

| | |
|---|---|
| ***F21K 99/00*** | (2010.01) |
| ***F21V 7/04*** | (2006.01) |
| ***F21V 29/00*** | (2015.01) |
| *F21Y 101/02* | (2006.01) |
| *F21W 131/101* | (2006.01) |
| *F21W 131/103* | (2006.01) |

(52) U.S. Cl.
CPC ..... *F21V 7/04* (2013.01); *F21V 29/004* (2013.01); *F21W 2131/101* (2013.01); *F21W 2131/103* (2013.01); *F21Y 2101/02* (2013.01)

(56) References Cited

U.S. PATENT DOCUMENTS 8,356,916 B2 1/2013 Gordin et al.
2006/0035511 A1 2/2006 Mrakovich et al.

FOREIGN PATENT DOCUMENTS

| | | | | |
|---|---|---|---|---|
| CN | 201246677 | | | 5/2009 |
| CN | 101446404 | | | 6/2009 |
| CN | 101545609 | A | * | 9/2009 |
| CN | 101782213 | A | | 7/2010 |
| CN | 102216677 | A | | 10/2011 |
| EP | 1781072 | A2 | | 5/2007 |

OTHER PUBLICATIONS

Unofficial English translation of Chinese Office Action issued in connection with corresponding CN Application No. 201110342006.3 on Dec. 31, 2014.

* cited by examiner

REFLECTOR, ILLUMINATOR AND THE USE THEREOF

FIELD OF THE INVENTION

The present invention relates to the illumination field, and especially to a reflector, an illuminator and the use thereof.

BACKGROUND OF THE INVENTION

LED illuminators have been used widely as they have the features of high luminous efficiency, energy saving, not needing high voltage, high safety and the like, and the performance thereof has exceeded majority of traditional light sources currently.

Chinese Invention Patent Application Publication No. CN101446404A discloses a LED street lamp and an irradiating light adjustment method of the LED street lamp. The street lamp comprises a lamp body and a LED luminotron, and the LED luminotron is mounted with a reflective cup through which the light emitted from the LED luminotron is reflected and then is concentrated and projected onto the road surfaces needing to be illuminated. The drawback is that more than 60% of the light from the LED light sources has to be reflected by the reflectors before they reach illuminated regions, resulting in the defect of low efficiency.

Chinese Patent of Utility Models Authorized Announcement No. CN201072071Y discloses a grid type LED street lamp reflector. The LED street lamp reflector comprises a reflection basal body whose edge is provided with a positioning hole, the reflection basal body is provided with one or more reflection grooves each of which has one or more LED light source hole sites, and reflection films are arranged on the reflector. The drawback is that the reflective surface profile of the grid type reflector is excessively simple, and the ability of controlling the direction of reflective light is relatively weak, so that it is difficult to meet the technical requirements of many illumination application places.

Chinese Patent of Utility Models Authorized Announcement No. CN201246677Y discloses a LED street lamp reflective shade including at least two LED reflective grooves arranged side by side, wherein a LED mounting hole is disposed on the bottom of the reflective grooves, inner surfaces of both sides of the reflective grooves form reflective surfaces which is paraboloid-shaped and a reflecting plate having an inverse "V" shape is respectively disposed above the LED mounting hole corresponding to the both ends on the sidewalls of the LED reflective grooves. The drawback is that the surface profile of each reflecting surface is simple, and the ability of controlling the direction of reflective light is not strong, so that it is difficult to meet the technical requirements of many illumination application places.

SUMMARY OF THE INVENTION

In view of the above, the present invention provides a reflector and an illuminator for providing an illumination having a uniform illuminance and a uniform brightness.

The present invention provides the following technical solutions:

1. A reflector comprises pairs of reflecting pieces, each pair of reflecting pieces comprising at least one reflecting unit, each reflecting unit including a first reflecting portion, a second reflecting portion, and a first fixing portion and a second fixing portion whose bottom ends are respectively connected to the first reflecting portion and the second reflecting portion, the first fixing portion located on the side of the first reflecting portion that is opposed to an optical center of the reflecting unit, the second fixing portion located on the side of the second reflecting portion that is opposed to the optical center of the reflecting unit, the first reflecting portion and the second reflecting portion having the shape of an arc curved surface which taperedly extends from the bottom end thereof to the top end and forming an opening, such that one part of light emitted from a light source located at the optical center inside the reflecting unit passes through the opening directly and the other part of light passes through the opening after reflected by the reflecting portions.

2. The reflector according to technical solution 1, wherein the arc curved surface shape is a free-form curved surface shape.

3. The reflector according to technical solution 2, wherein the free-form curved surface is formed by free-form curves on the plane groups through an optical axis, wherein the optical axis is the axis passing through the optical center of the reflecting unit.

4. The reflector according to technical solution 2, wherein the free-form curved surface is formed by straight lines on the plane groups through an optical axis, wherein the optical axis is the axis passing through the optical center of the reflecting unit and the straight lines are aligned along a free-form curve so as to form the free-form curved surface.

5. The reflector according to one of technical solutions 1 to 4, wherein each pair of reflecting pieces comprise a plurality of reflecting units, with the first fixing portions of the plurality of reflecting units connected with one another and the second fixing portions of the plurality of reflecting units connected with one another, and the plurality of reflecting units are arranged such that the light sources located at the optical centers of the reflecting units are arranged in a line.

6. The reflector according to one of technical solutions 1 to 4, wherein the reflector comprises a plurality pairs of reflecting pieces which are arranged such that the light sources located at the optical centers of the reflecting units are arranged in parallel lines or in a line.

7. The reflector according to one of technical solutions 1 to 4, wherein the openings of the reflecting portions can be any angle from 30° to 120°.

8. An illuminator comprises a heat sinking plate, a base plate, a light source, and at least one reflector according to one of the aforesaid technical solutions, wherein the heat sinking plate is fixed to the base plate, the first fixing portion and the second fixing portion are fixed to the heat sinking plate or the base plate, and the light source is fixed to the heat sinking plate and located at the optical center of the reflecting unit, such that one part of light emitted from the light source passes through the opening directly and the other part of light passes through the opening after reflected by the first reflecting portion and the second reflecting portion.

9. The illuminator according to technical solution 8, wherein the illuminator further comprises a transparent casing which is fixed to the base plate or heat sinking plate for accommodating the light source and the reflector.

10. The illuminator according to technical solution 8 or technical solution 9, wherein the light source is a LED lamp.

11. A use of the illuminator according to one of the technical solutions 8-10, wherein the illuminator is used for road illumination, tunnel illumination and prolate shape region illumination.

The technical effects of the present invention lie in that: the optical efficiency is extremely high, the light distribution form is multiple, and the chip layout is deconcentrate and flexible, thereby being especially applicable to prolate shape illuminated regions. The light capable of irradiating illuminated regions directly can be emitted directly without via the reflector to the greatest extent; and the light incapable of irradiating illuminated regions directly can as far as possible reach illuminated regions just by being reflected one time. The direct light and the reflected light achieve flexible light distribution forms in accordance with different forms of overlap matching.

According to the present invention, the road illumination, tunnel illumination for various road surface materials and prolate shape region illumination such as corridor illumination, shelf illumination, underground garage illumination and the like having a uniform illuminance and a uniform brightness can be achieved.

DESCRIPTION OF THE INVENTION

Hereinafter, embodiment(s) of the present invention will be described in detail in association with the accompanying drawings wherein like reference numbers indicate like elements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising" and the like when used in this specification, specify the presence of stated features, elements, and/or components, but do not preclude the presence or addition of one or more other features, elements, components, and/or groups thereof.

Figure 1:
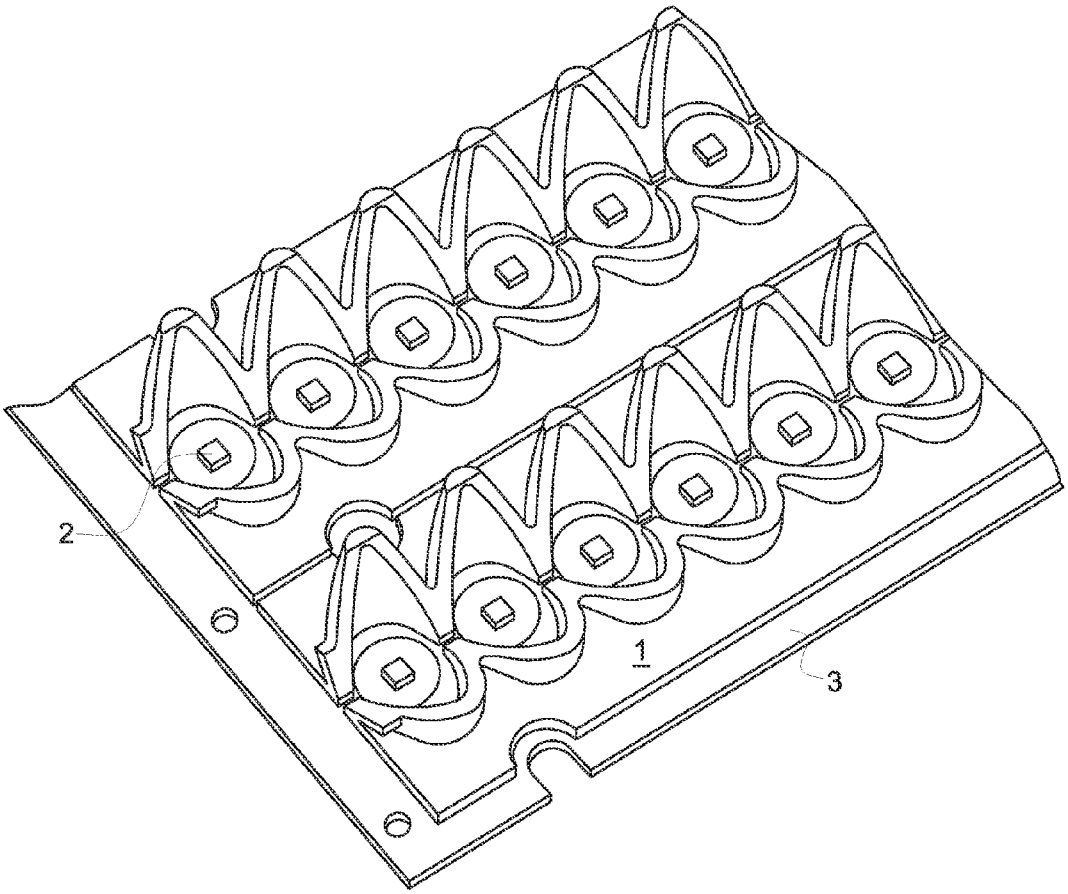
FIG. 1 is a structural schematic diagram of an illuminator according to the present invention.
Figure 2:
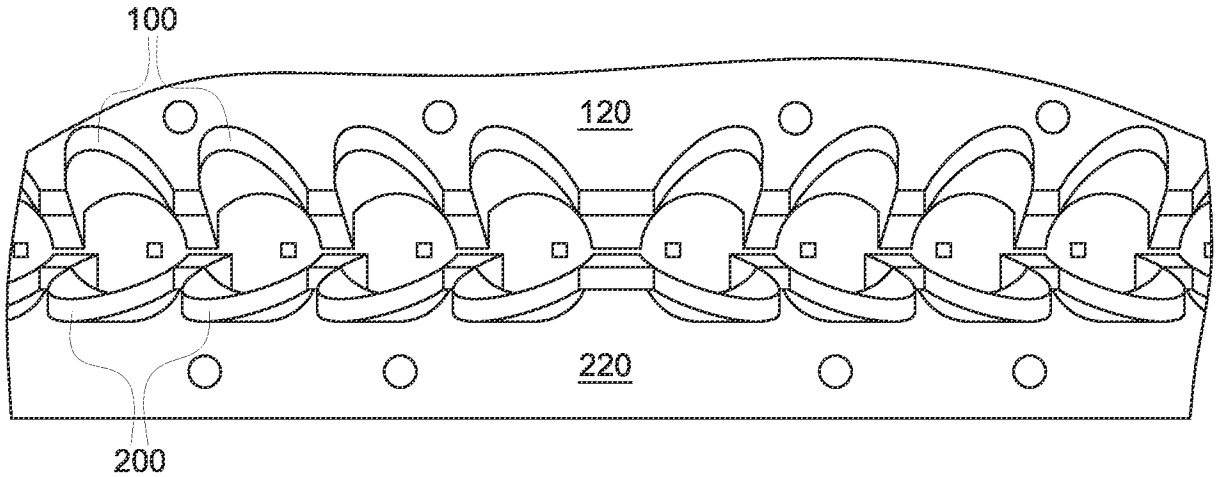
FIG. 2 is a structural schematic diagram of a reflector.
Figure 3:
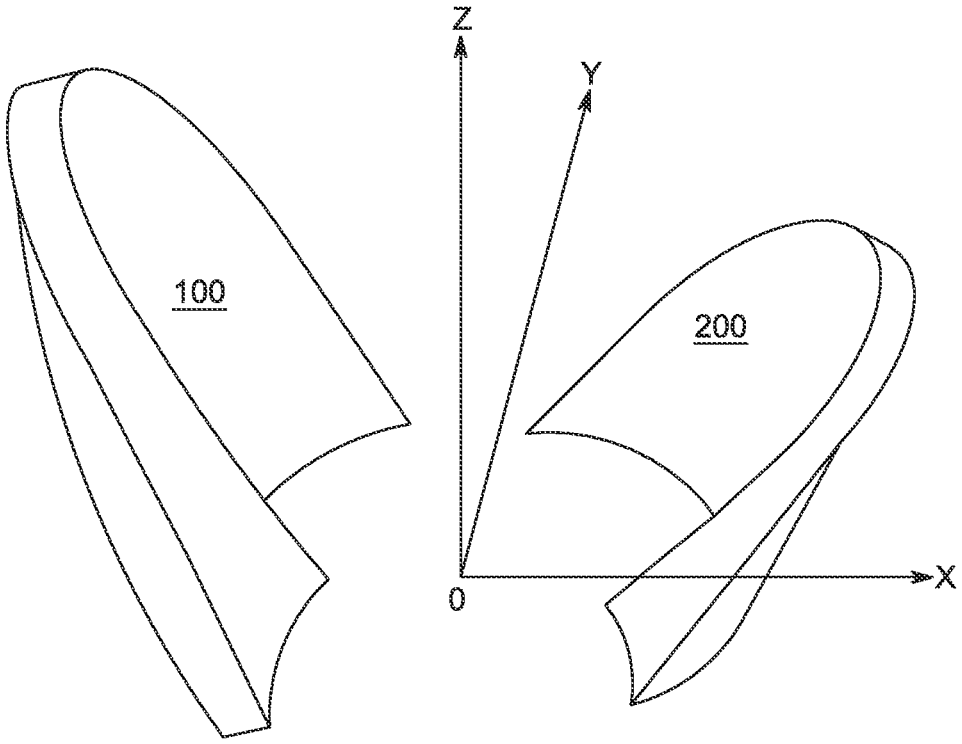
FIG. 3 is an enlarged schematic diagram of a reflecting portion.

FIG. 1 is a structural schematic diagram of an illuminator according to the present invention. FIG. 2 is a structural schematic diagram of a reflector. FIG. 3 is an enlarged schematic diagram of a reflecting portion.

Hereinafter, the illuminator, the reflector and a reflecting piece of the present invention will be described in association with FIGS. 1 and 2.

As illustrated in FIGS. 1 to 3, the illuminator comprises a reflector 1, a light source 2, a heat sinking plate (not shown) and a base plate 3. The heat sinking plate is fixed to the base plate 3, the reflector 1 is fixed to the heat sinking plate or the base plate 3, and the light source 2 is fixed to the heat sinking plate and located at the optical center of a reflecting unit, such that one part of light emitted from the light source passes through an opening directly and the other part of light passes through the opening after reflected by the reflector 1. The light source 2 may be a LED lamp.

The reflector 1 comprises pairs of reflecting pieces, and each pair of reflecting pieces comprise at least one reflecting unit with each one including a first reflecting portion 100, a second reflecting portion 200, a first fixing portion 120, and a second fixing portion 220. The first fixing portion 120 is connected to the bottom end of the first reflecting portion 100, and the second fixing portion 220 is connected to the bottom end of the second reflecting portion 200. The first fixing portion 120 and the second fixing portion 220 are fixed to the heat sinking plate or the base plate 3, and the light source 2 is fixed to the heat sinking plate and located at the optical center of the reflecting unit.

The first fixing portion 120 is located on the side of the first reflecting portion 100 that is opposed to the optical center of the reflecting unit, and the second fixing portion 220 is located on the side of the second reflecting portion 200 that is opposed to the optical center of the reflecting unit. The first reflecting portion 100 and the second reflecting portion 200 have the shape of an arc curved surface which taperedly extends from the bottom end thereof to the top end and form an opening, such that one part of light emitted from the light source 2 located at the optical center of the reflecting unit passes through the opening directly and the other part of light passes through the opening after reflected by the first and second reflecting portions 100 and 200.

As illustrated in FIGS. 1 and 2, each pair of reflecting pieces comprise several reflecting units each of which has the respective first fixing portions 120 connected with one another and the respective second fixing portions 220 connected with one another. A plurality of reflecting units are arranged such that the light sources located at the optical centers of the reflecting units are arranged in a line. The present invention is not limited to the number shown in FIGS. 1 and 2, and one skilled in the art may set the number of the reflecting units to one or more according to actual situations.

As illustrated in FIG. 1, the reflector 1 comprises two pairs of reflecting pieces which are arranged such that the light sources located at the optical centers of the reflecting units are arranged in parallel lines. It should be noted that although the reflecting pieces are arranged such that the light sources located at the optical centers of the reflecting units are arranged in parallel lines in FIG. 1, the reflecting pieces may also be arranged such that the light sources are arranged in a line.

It should be noted that although the illuminator shown in FIG. 1 comprises two reflectors, one skilled in the art may determine the number of the reflectors according to actual demands, such as comprising one reflector or more than one reflector.

As illustrated in FIG. 1, the shapes of the plurality of reflecting units may be the same. However, the shapes of the plurality of reflecting units in the present invention may be different.

As illustrated in FIG. 3, X axis, Y axis, Z axis and origin O are defined in such a manner that the X axis, Y axis, Z axis are perpendicular to one another and the origin O is located at an optical center of the optical unit. The Y axis is the axis passing through the optical center of the reflecting unit, and the X-Y plane constitutes the bottom surface of the first reflecting portion 100 and the second reflecting portion 200.

Figure 4:
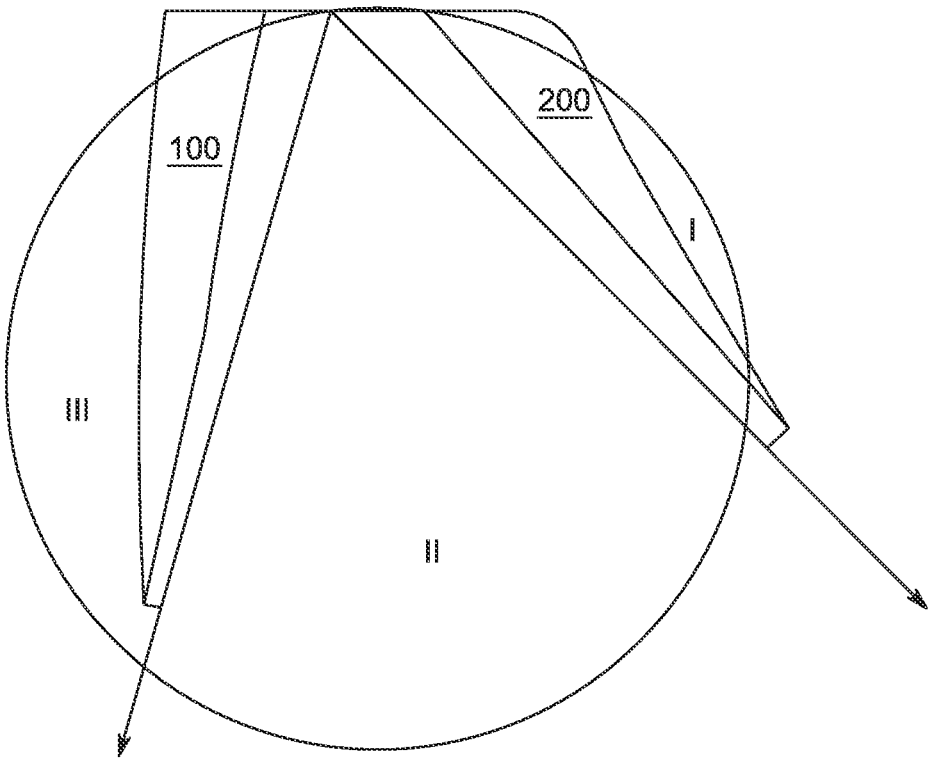
FIG. 4 is an enlarged schematic diagram of a light path of an reflecting unit according to the present invention.

FIG. 4 is an enlarged schematic diagram of a light irradiation of the reflecting unit according to the present invention. As shown in the diagram, on the X-Y plane and in the Z axis direction, light from part II is projected onto a region to be irradiated without any blocking at all, and light from parts I and III is projected onto the region to be irradiated uniformly after reflected by the first reflecting portion 100 and the second reflecting portion 200.

Therefore, the optical efficiency of the present invention is extremely high. The light capable of irradiating illuminated regions directly can be emitted directly without via the reflector to the greatest extent; and the light incapable of irradiating illuminated regions directly can reach illuminated regions just by being reflected.

Figure 5A:
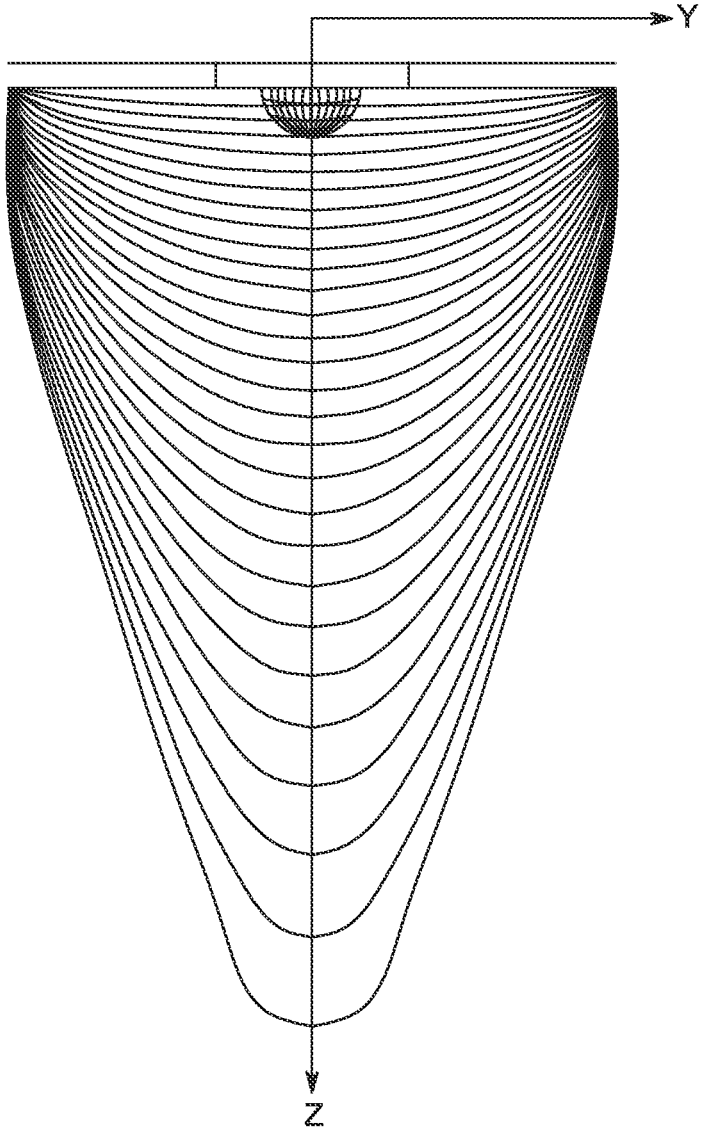
FIGS. 5A-5B are diagrams of a free-form curve projected onto the Y-Z plane.
Figure 5B:
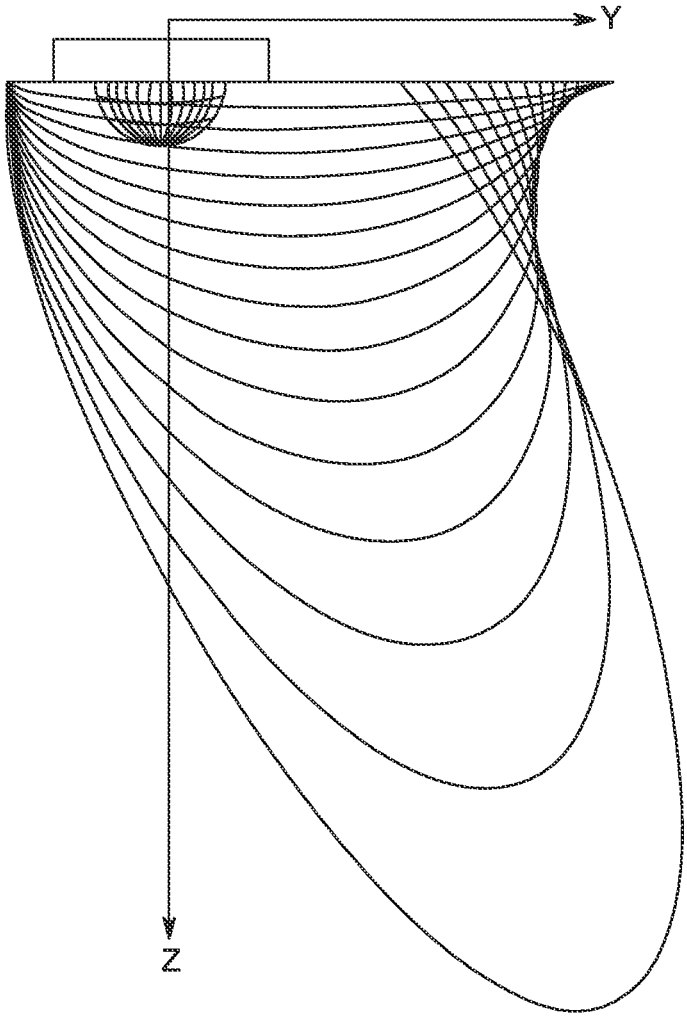
Figure 6A:
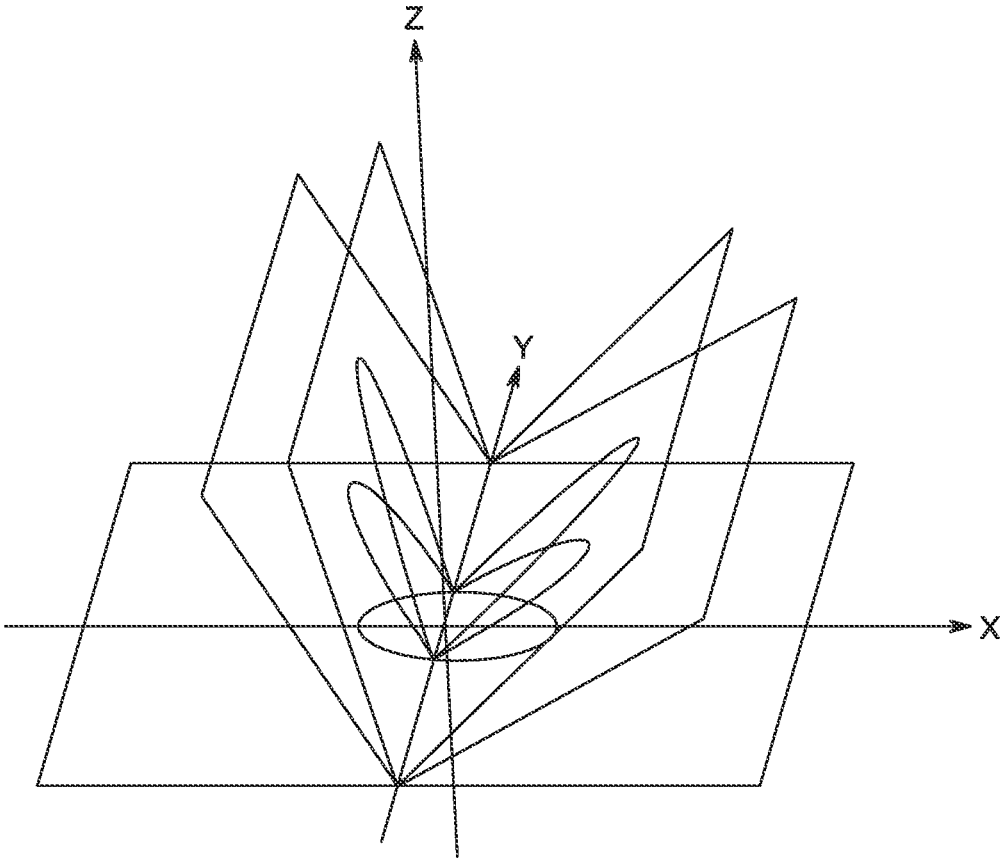
FIG. 6A is a schematic diagram of the free-form curve.
Figure 6B:
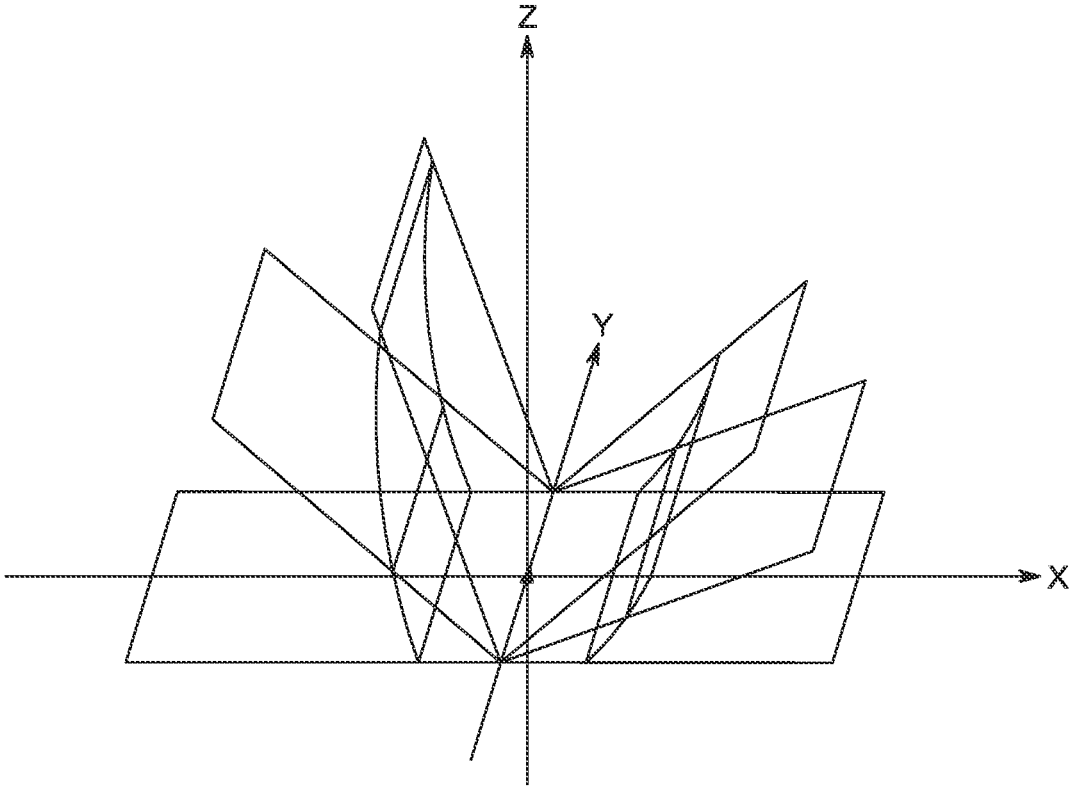
FIG. 6B is a schematic diagram of another free-form curve.

The arc curved surface shape of the reflecting portions 100 and 200 is a free-form curved surface shape. FIGS. 5A-5B are diagrams of a free-form curve projected onto the Y-Z plane. FIG. 6A is a schematic diagram of the free-form curve in FIG. 5A. FIG. 6B is a schematic diagram of another free-form curve.

As illustrated in FIGS. 5A, 5B and 6A, the free-form curved surface is formed by free-form curves on the plane groups through the Y axis. As illustrated in FIGS. 5A and 6A, the free-form curved surface is formed by free-form curves on the plane groups through the Y axis and the free-form curves are symmetric with respect to Z axis. Compared with FIG. 5A, the free-form curved surface shown in FIG. 5B is formed by free-form curves on the plane groups through the Y axis and the free-form curves are dissymmetric with respect to Z axis.

FIG. 6B is a schematic diagram of another free-form curve. As illustrated in FIG. 6B, the free-form curved surface is formed by a plurality of straight lines on the plane groups through the Y axis, wherein the straight lines are aligned along a free-form curve so as to form the free-form curved surface.

Figure 7:
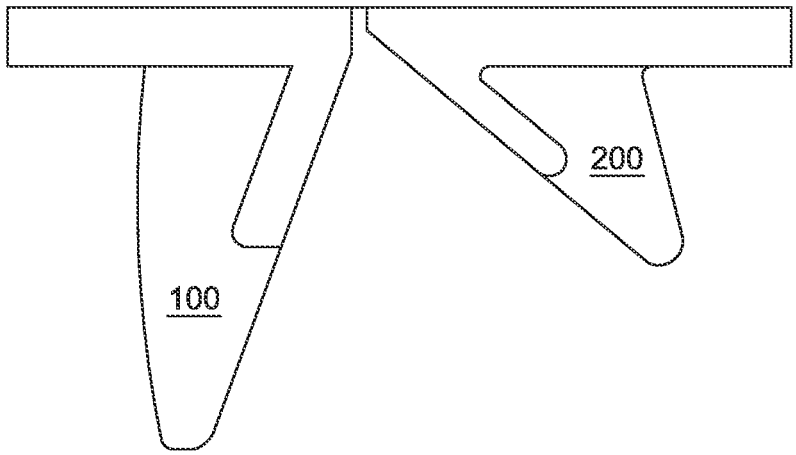
FIG. 7 is a schematic diagram of an opening of the reflector according to the present invention.

FIG. 7 is a schematic diagram of an opening of the reflector according to the present invention, and those skilled in the art of the present invention may adjust the size of the opening according to actual demands (i.e. according to the ratio of road width to lamp stem height), in order to be adapted to the types I to IV of the light distribution. Wherein the type I of the light distribution is adapted to a narrower road where the road width is smaller than the lamp stem height; the type IV of the light distribution is adapted to a very wide road where the road width is larger more than 2.25 times the lamp stem height. As shown in the diagram, the openings of the reflecting portions 100 and 200 of the reflectors can be any angle from 30° to 120°.

Therefore, the light distribution form of the present invention is multiple. The direct output light and the reflected light achieve flexible light distribution forms which are adapted to light distributions for various road surfaces in accordance with different forms of overlap matching.

Alternatively, the first reflecting portion 100 and the first fixing portion 120 may shaped integrally, and the second reflecting portion 200 and the second fixing portion 120 may shaped integrally.

Alternatively, the reflecting portions 100 and 200 distribute at intervals. Although the reflecting portions are shown as distributed at equal intervals in the embodiment illustrated in the diagram, the present invention is not limited to this, they also can be distributed at unequal intervals. One skilled in the art may adjust intervals between the reflecting portions according to actual demands.

As illustrated in FIG. 1, the shape of the first reflecting portion 100 and the shape of the second reflecting portion 200 are different. Alternatively, as illustrated in FIG. 2, the shape of the first reflecting portion 100 and the shape of the second reflecting portion 200 may also be the same.

Figure 8:
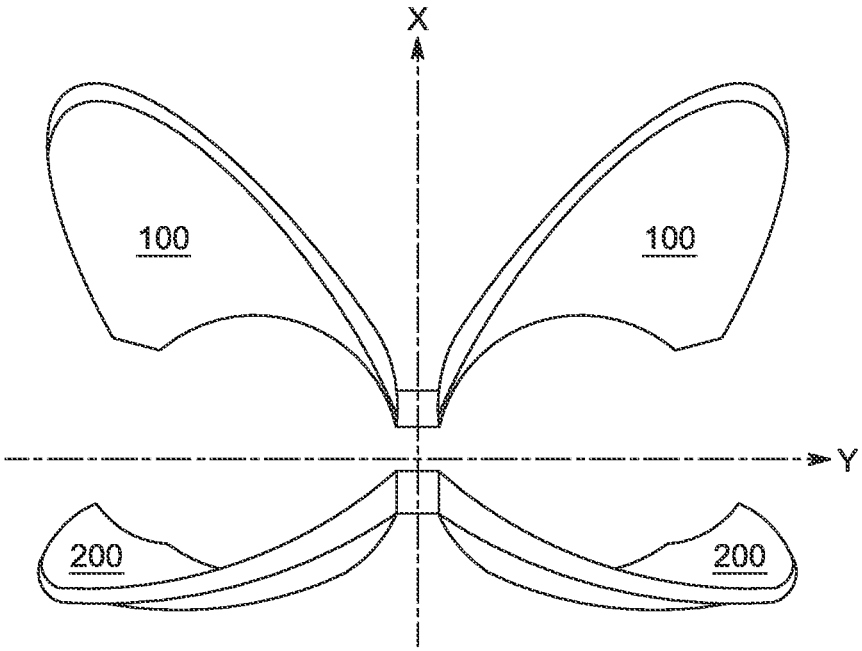
FIG. 8 is an enlarged schematic diagram of another reflecting portion.

FIG. 8 is an another structural schematic diagram of reflecting portions. As shown in the diagram, the reflecting portions 100 and 200 are in mirror symmetry.

Alternatively, the illuminator according to the present invention may further comprise a transparent casing (not shown) which is fixed to the base plate or heat sinking plate for accommodating the reflector and the light source.

Figure 9:
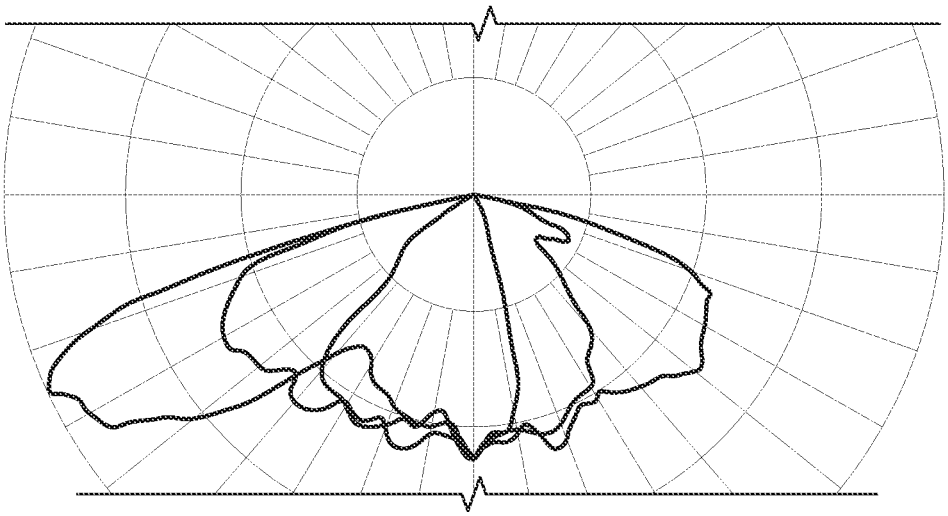
FIG. 9 is a light distribution effect diagram of the illuminator according to the present invention.

FIG. 9 is a light distribution effect diagram of the illuminator according to the present invention, showing a light intensity distribution of the illuminator. Generally, the optical efficiency of the illuminator according to the present invention has been proved to be 94.5-97.5% by practice (without considering the loss of the transparent casing). It makes an effective use of light emitted from light sources.

The illuminator according to the present invention can be used for, including but not limited to, road illumination, tunnel illumination and prolate shape region illumination. The prolate shape region includes but not limited to furniture, supermarket shelf, corridor, underground garage and rail.

In view of these teachings, other embodiments, combinations and modifications of the present invention will be apparent to those skilled in the present field. Therefore, the invention is only defined by the claims when reading in connection with the above description and drawings.

What is claimed is:

1. A reflector, comprising;

pairs of reflecting pieces, wherein each pair of reflecting pieces comprises at least one reflecting unit, each reflecting unit comprising:

a first reflecting portion;

a second reflecting portion; and a first fixing portion and a second fixing portion whose bottom ends are respectively connected to the first reflecting portion and the second reflecting portion, wherein:

the first fixing portion is located on the side of the first reflecting portion that is opposed to an optical center of the reflecting unit, the second fixing portion is located on the side of the second reflecting portion that is opposed to the optical center of the reflecting unit, and the first reflecting portion and the second reflecting portion have the shape of an arc curved surface which taperedly extends from the bottom end thereof to the top end and form an opening, such that one part of light emitted from a light source located at the optical center inside the reflecting unit passes through the opening directly and the other part of light passes through the opening after reflected by the reflecting portions.

2. The reflector according to claim 1, wherein the arc curved surface shape is a free-form curved surface shape.

3. The reflector according to claim 2, wherein the free-form curved surface is formed by free-form curves on the plane groups through an optical axis, wherein the optical axis is the axis passing through the optical center of the reflecting unit.

4. The reflector according to claim 2, wherein the free-form curved surface is formed by straight lines on the plane groups through an optical axis, wherein the optical axis is the axis passing through the optical center of the reflecting unit and the straight lines are aligned along a free-form curve so as to form the free-form curved surface.

5. The reflector according to claim 1, wherein each pair of reflecting pieces comprises a plurality of reflecting units, with the first fixing portions of the plurality of reflecting units connected with one another and the second fixing portions of the plurality of reflecting units connected with one another, and the plurality of reflecting units are arranged such that the light sources located at the optical centers of the reflecting units are arranged in a line.

6. The reflector according to claim 1, wherein the reflector comprises a plurality pairs of reflecting pieces arranged such that the light sources located at the optical centers of the reflecting units are arranged in parallel lines or in a line.

7. The reflector according to claim 1, wherein the openings of the reflecting portions can be any angle from 30° to 120°.

8. An illuminator comprising;

a heat sinking plate;

a base plate;

a light source; and a reflector comprising:

pairs of reflecting pieces, wherein each pair of reflecting pieces comprises at least one reflecting unit, each reflecting unit comprising:

a first reflecting portion;

a second reflecting portion; and a first fixing portion and a second fixing portion whose bottom ends are respectively connected to the first reflecting portion and the second reflecting portion, wherein:

the first fixing portion is located on the side of the first reflecting portion that is opposed to an optical center of the reflecting unit, the second fixing portion is located on the side of the second reflecting portion that is opposed to the optical center of the reflecting unit, and the first reflecting portion and the second reflecting portion have the shape of an arc curved surface which taperedly extends from the bottom end thereof to the top end and form an opening, wherein the heat sinking plate is fixed to the base plate, the first fixing portion and the second fixing portion are fixed to the heat sinking plate or the base plate, and wherein the light source is fixed to the heat sinking plate and located at the optical center of the reflecting unit, such that one part of light emitted from the light source passes through the opening directly and the other part of light passes through the opening after reflected by the first reflecting portion and the second reflecting portion.

9. The illuminator according to claim 8, wherein the illuminator further comprises a transparent casing fixed to the base plate or the heat sinking plate for accommodating the light source and the reflector.

10. The illuminator according to claim 8, wherein the light source is a LED lamp.

11. The illuminator according to claim 8, wherein the illuminator is used for road illumination, tunnel illumination, or prolate shape region illumination.

12. The reflector according to claim 2, wherein each pair of reflecting pieces comprises a plurality of reflecting units, with the first fixing portions of the plurality of reflecting units connected with one another and the second fixing portions of the plurality of reflecting units connected with one another, and the plurality of reflecting units are arranged such that the light sources located at the optical centers of the reflecting units are arranged in a line.

13. The reflector according to claim 2, wherein the reflector comprises a plurality pairs of reflecting pieces arranged such that the light sources located at the optical centers of the reflecting units are arranged in parallel lines or in a line.

14. The reflector according to claim 2, wherein the openings of the reflecting portions can be any angle from 30° to 120°.

15. The reflector according to claim 3, wherein each pair of reflecting pieces comprises a plurality of reflecting units, with the first fixing portions of the plurality of reflecting units connected with one another and the second fixing portions of the plurality of reflecting units connected with one another, and the plurality of reflecting units are arranged such that the light sources located at the optical centers of the reflecting units are arranged in a line.

16. The reflector according to claim 3, wherein the reflector comprises a plurality pairs of reflecting pieces arranged such that the light sources located at the optical centers of the reflecting units are arranged in parallel lines or in a line.

17. The reflector according to claim 3, wherein the openings of the reflecting portions can be any angle from 30° to 120°.

18. The reflector according to claim 4, wherein each pair of reflecting pieces comprises a plurality of reflecting units, with the first fixing portions of the plurality of reflecting units connected with one another and the second fixing portions of the plurality of reflecting units connected with one another, and the plurality of reflecting units are arranged such that the light sources located at the optical centers of the reflecting units are arranged in a line.

19. The reflector according to claim 4, wherein the reflector comprises a plurality pairs of reflecting pieces arranged such that the light sources located at the optical centers of the reflecting units are arranged in parallel lines or in a line.

20. The reflector according to claim 4, wherein the openings of the reflecting portions can be any angle from 30° to 120°.

* * * * *

UNITED STATES PATENT AND TRADEMARK OFFICE

CERTIFICATE OF CORRECTION

PATENT NO. : 9,086,204 B2
APPLICATION NO. : 14/352166
DATED : July 21, 2015
INVENTOR(S) : Zou et al.

It is certified that error appears in the above-identified patent and that said Letters Patent is hereby corrected as shown below:

On the Title Page, item (73), under "Assignee", in Column 1, Line 1, delete "GE LIGHTING SOLUTIONS, LLC.," and insert -- GE LIGHTING SOLUTIONS, LLC, --, therefor.

In the specification

In Column 3, Line 39, delete "Hereinafter," and insert -- Hereinafter, preferred --, therefor.

In the claims

In Column 6, Line 26, in Claim 1, delete "comprising;" and insert -- comprising: --, therefor.

In Column 7, Line 10, in Claim 8, delete "comprising;" and insert -- comprising: --, therefor.

Signed and Sealed this
First Day of December, 2015

Michelle K. Lee

Michelle K. Lee
*Director of the United States Patent and Trademark Office*